US005651482A

United States Patent [19]

Sizemore

[11] Patent Number: 5,651,482

[45] **Date of Patent: *Jul. 29, 1997**

[54] SYRUP DELIVERY KIT FOR VENDING SYSTEM

[76] Inventor: Sean S. Sizemore, 1509 Salem Lake Rd., Winston-Salem, N.C. 27107

[ * ] Notice: The term of this patent shall not extend beyond the expiration date of Pat. No. 5,507,415.

[21] Appl. No.: 472,562

[22] Filed: Jun. 7, 1995

Related U.S. Application Data

[63] Continuation-in-part of Ser. No. 236,184, May 2, 1994, Pat. No. 5,507,415, which is a continuation of Ser. No. 2,268, Jan. 8, 1993, Pat. No. 5,341,957.

[51] Int. Cl.[6] ..... G04C 1/12

[52] U.S. Cl. ..... 222/640; 222/129.1

[58] Field of Search ..... 222/129.1–129.4, 222/2, 66, 325, 255, 640, 641

[56] References Cited

U.S. PATENT DOCUMENTS

| | | | |
|---|---|---|---|
| 4,467,941 | 8/1984 | Du | 222/1 |
| 4,544,328 | 10/1985 | Credle, Jr. | 417/33 |
| 4,615,466 | 10/1986 | Credle, Jr. | 222/129.1 |
| 4,629,589 | 12/1986 | Gupta et al. | 261/34.1 |
| 4,753,370 | 6/1988 | Rudick | 222/105 |
| 4,781,310 | 11/1988 | Credle, Jr. et al. | 222/129.1 |
| 4,801,048 | 1/1989 | Credle, Jr. et al. | 222/129.1 |
| 4,898,303 | 2/1990 | Large et al. | 222/65 |
| 4,913,316 | 4/1990 | Richter | 221/1 |
| 4,928,853 | 5/1990 | Isham et al. | 222/108 |
| 5,000,351 | 3/1991 | Rudick | 222/105 |
| 5,042,689 | 8/1991 | Mrugala et al. | 222/66 |
| 5,082,143 | 1/1992 | Schramm, Jr. | 222/66 |
| 5,086,951 | 2/1992 | Nakayama et al. | 222/129.1 |
| 5,121,857 | 6/1992 | Hutchinson | 222/318 |
| 5,145,092 | 9/1992 | Shannon | 222/61 |
| 5,507,415 | 4/1996 | Sizemore | 222/129.1 |

OTHER PUBLICATIONS

B.I.B. Vent schematic from Lancer Corporation, Jul. 13, 1989, P.N. 28–0011.

*Primary Examiner*—Gregory L. Huson
*Attorney, Agent, or Firm*—Rhodes, Coats & Bennett, L.L.P.

[57] ABSTRACT

A syrup delivery kit for improving the delivery of syrup in a cup-type vending machine in which the syrup is initially contained in a bag-in-box container. The syrup delivery kit includes a fluid flow restricting means, a supply pump for transferring syrup downstream through a feed conduit towards the fluid flow restricting means, a vent device, and supply conduits for interconnecting the supply pump, the vent device, and the fluid flow restricting means together and to the bag-in-box container.

24 Claims, 5 Drawing Sheets

SYRUP DELIVERY KIT FOR VENDING SYSTEM

This is a continuation-in-part application of application Ser. No. 08/236,184, filed May 2, 1994, now U.S. Pat. No. 5,507,415, which is a continuation application of application Ser. No. 08/002,268, filed Jan. 8, 1993, and now U.S. Pat. No. 5,341,957.

FIELD OF THE INVENTION

The present invention is related generally to beverage dispensing vending machines, and more particularly to syrup delivery kits for cup-type vending machines.

BACKGROUND OF THE INVENTION

The two primary types of vending machines used to dispense beverages are bottle/can vending machines which dispense individual, pre-packaged beverages and cup-type vending machines which dispense a liquid beverage from a nozzle and into an awaiting cup. The bottling industry both supplies and maintains a large control over the current bottle/can vending machines.

The vending industry has recognized the need to increase the use of cup-type vending machines in order to compete with bottle/can vending machines. In order for cup-type vending machines to better compete with bottle/can vending machines, cup-type vending machines of the prior art need to be improved.

Cup-type vending machines must be designed to successively dispense beverages into cups. The successive dispensing of beverages should not be periodically interrupted by failures in the vending machine to properly dispense a beverage. In addition, cup-type vending machines should be designed to offer a wide variety of beverages and should limit the intervals at which machines must be restocked.

Problems and difficulties have occurred with cup-type vending machines due to a recent development in how beverage syrup located in the vending machine is packaged. Early cup-type vending machines used non-pressurized, holding tanks to supply the beverage syrup. The holding tanks used with the early cup-type vending machines were rigid and contained air. Because of the rigid shape of the holding tank, and the fact that the air was contained in the top section of the tank, and a withdrawal tube drew syrup from a point beneath the level of the fluid, such vending machines did not have a problem with air entering the dispensing system. A recent change in the preferred packaging of syrup has created problems for cup-type vending machines that have not been overcome by the vending industry.

The preferred packaging of beverage syrups which supply vending machines is now a disposable, flexible package referred to as a bag-in-box package (BIB package). BIB packages include a flexible bag for containing syrup and a box for holding the bag, and are preferred because of sanitation and economy factors. The BIB packages are designed to be connected to a dispensing system that controllably dispenses a fixed amount of syrup into a cup. Once all the syrup in a BIB package has been dispensed, the used BIB package is disposed and a full BIB package is brought on line. In order to avoid to limit the intervals at which a vending machine must be restocked, BIB packages containing the same type of syrup are sequentially connected by a changeover valve that automatically switches to a second full BIB package upon depletion of a first BIB package.

One primary problem with cup-type vending machines of the prior art is their inability to account for air that enters the dispensing system when BIB packages are used to supply the vending machine. The BIB packages used to dispense syrup contain at least some air in the bags and when a full BIB package is manually placed on-line or when a full BIB package is automatically switched on line by a change-over valve, air will enter the dispensing system.

Prior art dispensing systems used in cup-type vending machines include a bellows pump and/or a diaphragm pump which uses a vacuum to successively draw a pre-set amount of syrup from the syrup supply for each vend. A vend refers to each time a customer makes a payment into the vending machine and selects a beverage. When these prior art dispensing systems are used with BIB packages, air from the BIB packages enters the dispensing system and flows through the diaphragm or bellows pump. The diaphragm or bellows pump treats air in the system as if it were syrup and destroys the dispensing system's ability to successfully draw and dispense a pre-set amount of syrup into a cup for each vend. Each time a new BIB package is brought on-line, air enters the dispensing system and causes approximately two to five vends to malfunction and not properly dispense beverage syrup into the awaiting cup.

In a vending environment, the failure of the dispensing system to properly dispense the selected beverage for several successive vends each time a new BIB package is brought on-line is a serious problem. Customers may rightfully refuse to patronize a cup-type vending machine that fails to dispense the selected beverage after the vending machine has accepted payment from the customer.

No one in the vending industry has solved the problem of air entering the dispensing system when BIB packages are used. One different type of beverage dispensing system, a counter-top beverage dispenser typically used for over-the-counter sales, has been adapted with a vent valve to help eliminate air entering the dispensing system when BIB packages are used. Unlike vending machines, counter-top beverage dispensers do not require a direct payment into a coin-operated mechanism controlling the beverage dispenser. Instead, for the counter-top beverage dispensers, a customer typically pays an operator who dispenses the beverage by pressing the selection button, and allows an individual to release a beverage from a nozzle upon pressing a selection button or cup lever associated with an offered beverage.

The selection button activates a solenoid-operated valve which releases a pressurized beverage fluid. In a limited number of counter-top beverage dispensers, a vent valve is positioned before the solenoid-operated valve which controls the release of the beverage into a cup. The counter-top beverage dispensers are pressurized systems that continuously supply and maintain a pressurized beverage fluid to the solenoid-operated valve. Vent valves are infrequently used in counter-top beverage dispensers because the introduction of air into the dispensing system of a counter-top beverage dispenser is not a significant problem. Because the dispensing systems of counter-top beverage dispensers are pressurized, air is compressed at the solenoid valve. Compressed air does not substantially interfere with the dispensing of beverages from the solenoid valve and seldom causes malfunctioning vendor serves where a customer fails to receive a beverage after payment and selection has been made. When a malfunctioning vend does occur in a counter-top beverage machine, no significant problem occurs because an operator simply re-presses the beverage release button to allow the air to escape.

In contrast, cup-type vending machines use a different type of dispensing system and are designed for a different purpose. Cup-type vending machines, for example, use a vacuum-type dispensing system, and in addition, malfunctioning vends cannot be rectified by an operator simply re-pressing a button. Air introduced into a vacuum-type dispensing system has a more adverse effect on the dispensing system and creates more vending malfunctions as compared to a pressurized system using a solenoid valve. In addition, a customer is left without a beverage after making a payment when there is a malfunctioning of a vending machine. Thus, introduction of air into the dispensing system of a cup-type vending machine creates a substantial problem. No one in the vending industry has successfully solved this problem.

Another hindrance to expanded use of cup-type vending machines is the relatively large space requirements needed for a cup-type vending machine. Cup-type vending machines typically offer several different types of beverages for selection. For each beverage offered for selection, multiple BIB packages and a separate pumping system is needed for each beverage offered. Further, other components such as a cup carousel, a carbonator, a refrigeration system, a $CO_2$ cylinder, and an icemaker must also be made available.

Some cup-type vending machines of the prior art do not have the space for a plurality of BIB packages. Many cup-type vending machines currently available are designed to supply beverage syrup from holding tanks. These currently available vending machines cannot typically be easily converted to hold a plurality of BIB packages. In an attempt to reduce the space requirements, the number of beverages offered for selection or the number of BIB packages successively connected together for each type of beverage can be reduced. However, limiting the number of beverages offered for selection reduces total sales, and limiting the number of packages successively connected together requires the machines to be restocked more frequently. Such measures to account for the space requirements of a vending machine limits the ability of cup-type vending machines to compete with bottle/can vending machines.

The vending industry has not been able to solve the above-discussed problems of cup-type vending machines, and an improved cup-type vending machine is needed.

SUMMARY OF THE INVENTION

The present invention is an improved beverage vending system for automatically dispensing an offered beverage into a cup in response to a customer's payment and selection of an offered beverage. Each offered beverage is supplied by a plurality of disposable bag-in-box packages (BIB packages) that contain both syrup and air and that are connected together by a changeover valve. The improved beverage vending system includes an auxiliary cabinet for storing the BIB packages. The vending machine is interconnected to the auxiliary cabinet by a dispensing system. The auxiliary cabinet provides ample storage space for the BIB packages and other system components. In addition, the dispensing system is designed to eliminate malfunctioning vends or serves caused in prior art cup-type vending machines when air from the BIB packages enters the dispensing system of the beverage vending system.

The dispensing system is used to draw syrup from the BIB packages and selectively dispense a predefined amount of syrup through an output nozzle into an awaiting cup.

In one embodiment, the dispensing system includes a first pumping stage, a second pumping stage, and a vent valve connected between the first pumping stage and the second pumping stage. The first pumping stage includes a pump located in the vending machine. It is the function of the supply pump to maintain a predetermined pressure level in the feed conduit. As the syrup is pumped to the second pumping stage, the syrup passes through the vent valve under pressure. The increased pressure causes any air which has entered the dispensing system to be vented by the vent valve rather than being passed to the second pumping stage. The second pumping stage includes a diaphragm pump or a bellows pump for drawing a selected mount of syrup that has been passed through the vent valve and dispensing a selected amount of syrup into a cup. A pressure regulator is also positionable between the vent valve and the diaphragm or bellows pump for regulating the pressure of the syrup directed to the diaphragm or bellows pump.

Cup-type vending machines of the prior art that include a dispensing system with a bellows pump are convertible into a beverage vending system of the present invention. A conversion kit or syrup delivery kit according to a first embodiment including a pump, a vent valve, and a vacuum pressure regulator can be used to convert a cup-type vending machine of the prior art. To convert a prior art cup-type vending machine, the pump in the conversion kit is connected in the dispensing system between a supply conduit which connects to the BIB packages and to a feed conduit which leads towards the diaphragm or bellows pump. Once the pump is connected in the dispensing system, the pump transfers syrup downstream towards the diaphragm or bellows pump. The vent valve is connected in the feed conduit and vents air from the dispensing system. The vacuum pressure regulator is connected in the feed conduit after the vent valve and before the bellows pump to regulate the pressure of the syrup flowing towards the diaphragm or bellows pump. By connecting the pump, the vent valve, and the vacuum pressure regulator of the conversion kit in this manner, the cup-type vending machine of the prior art is converted into a beverage vending system of the present invention.

According to a second embodiment of the present invention, a syrup delivery kit is provided for improving the delivery of syrup in a cup-type vending machine in which the syrup is initially contained in a bag-in-box container. The syrup delivery kit includes a fluid flow restricting means, a supply pump, a vent device, and supply conduits. The supply pump transfers syrup downstream through a feed conduit towards the fluid flow restricting means. The vent device is disposed between the bag-in-box container and the fluid flow restricting means. The vent device removes air from the syrup while allowing the syrup to pass through the vent device. The supply conduits interconnect the supply pump, the vent device, and the fluid flow restricting means together and to the bag-in-box container.

The fluid flow restricting means of the syrup delivery kit according to the second embodiment may include a solenoid valve having a fluid flow control device. The fluid flow control device may be a turbine flow meter or a timer. Moreover, the vent device may be disposed between the supply pump and the solenoid valve.

According to third and fourth embodiments according to the present invention, syrup delivery kits of the type described above each include a fluid flow restricting means, a supply pump, a vent device, and supply conduits. The supply pump transfers syrup downstream through a feed conduit towards the fluid flow restricting means. The vent device is disposed between the bag-in-box container and the supply pump. The supply pump removes air from the syrup while allowing the syrup to pass through the vent device. The supply conduits interconnect the supply pump, the vent device, and the fluid flow restricting means together and to the bag-in-box container.

More particularly, in the syrup delivery kit according to the third embodiment, a second pump is provided downstream of the supply pump. The fluid flow restricting means may be disposed between the supply pump and the second pump. The fluid flow restricting means is preferably a vacuum regulator.

More particularly, in the syrup delivery kit of the fourth embodiment, the fluid flow restricting means includes a solenoid valve having a fluid flow control device. The fluid flow control device may be a turbine flow meter or a timer.

According to fifth and sixth embodiments according to the present invention, syrup delivery kits of the type described above are provided each having a fluid flow control means, a supply pump, a vent device, and supply conduits. The supply pump transfers syrup downstream through a feed conduit towards the fluid flow restricting means. The vent device is downstream from the fluid flow control means. The vent device removes air from the syrup while allowing the syrup to pass through the vent device. The supply conduits interconnect the supply pump, the vent device, and the fluid flow restricting means together and to the bag-in-box container.

More particularly, in the syrup delivery kit according to the fifth embodiment, the fluid flow restricting means is a vacuum regulator. The syrup delivery kit may further include a second pump downstream from the vent device.

More particularly, in the syrup delivery kit according to the sixth embodiment, the fluid flow restricting means includes a solenoid valve having a fluid flow control device. The fluid flow control device may be a turbine flow meter, a flow control, a metering stem, or a timer. The syrup delivery kit may further include a second pump downstream from the vent device.

Accordingly, it is an object of the present invention to provide a beverage vending system that eliminates air from the dispensing system to prevent malfunctioning vends.

Another object of the present invention is to provide a beverage vending system allowing for the storage of a plurality of disposable syrup containers and other system components.

Another object of the present invention is to provide a conversion kit for converting cup-type vending machines of the prior art to eliminate the problem of air entering the dispensing system.

DETAILED DESCRIPTION OF THE INVENTION

Figure 1:
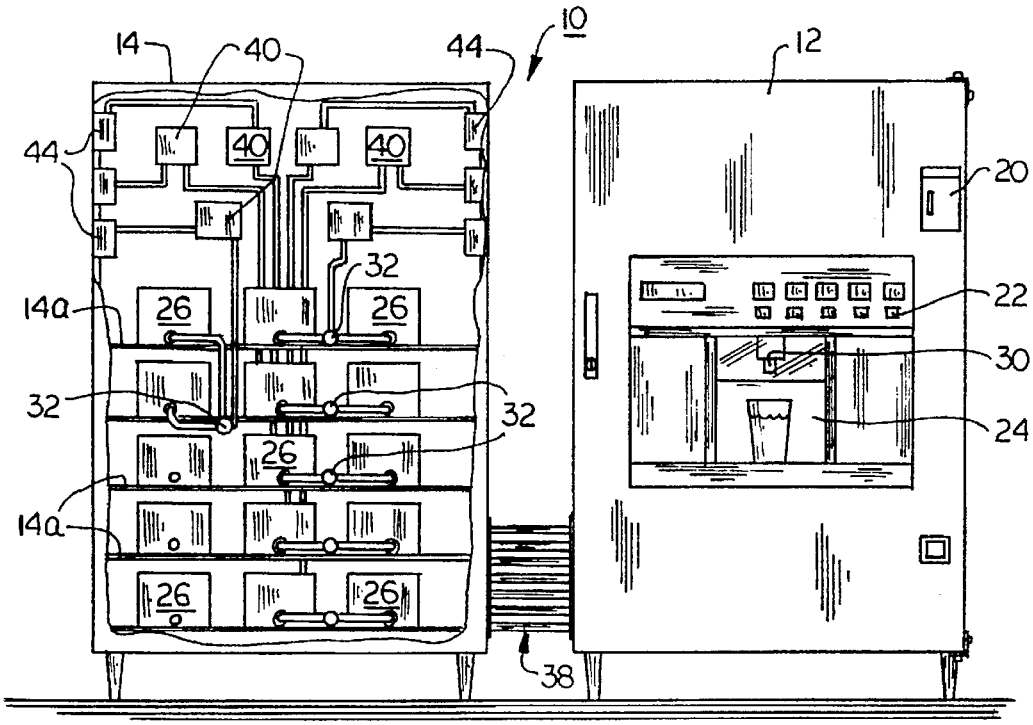
FIG. 1 is an overall view of the cup-type vending system showing the vending machine and the auxiliary cabinet.

Referring to the drawings, the beverage vending system of the present invention is indicated generally by the numeral 10. Beverage vending system 10 includes a vending machine 12, an auxiliary cabinet 14 and a beverage dispensing system 16. As shown in FIG. 1, vending machine 12 includes certain features common to cup-type vending machines of the prior art. On the front panel of the vending machine 12 is a currency input device 20 for a customer to deposit payment for a beverage. Currency input device 20 is a coin-operated device which accepts either coins or dollar bills. Beverage selection buttons 22 allow a customer to select the beverage of his choice. Once payment and selection has been made by the customer, a cup dispensing chamber 24 dispenses and supports a cup to receive the selected beverage.

Figure 2:
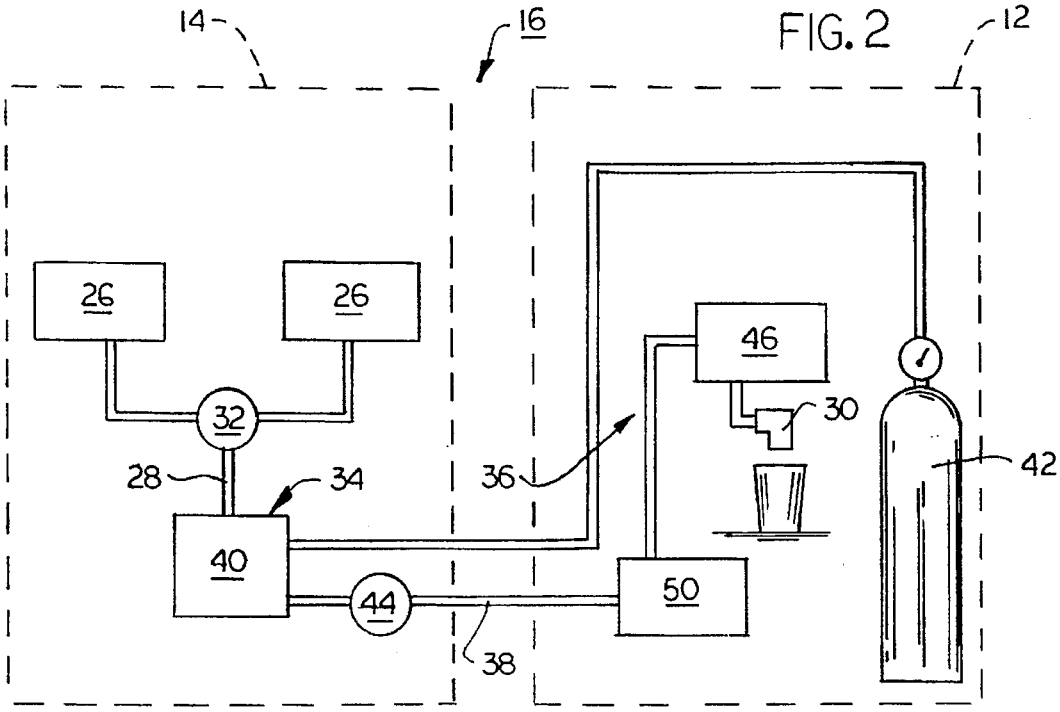
FIG. 2 is a schematic view of a beverage dispensing system according to a first embodiment of the present invention.

An auxiliary cabinet 14 is included in the cup-type vending system 10 to store disposable packages or containers of syrup used to supply the offered beverages. The preferred type of disposable packages used by vending system 10 are bag-in-box packages 26 (BIB packages). BIB packages 26 are known in the prior art and are aluminized plastic bladder bags that are flexible and filled with syrup and placed in a cardboard container. A full bag of BIB packages 26 will include both beverage syrup and air. Auxiliary cabinet 14 provides additional space to store a plurality of BIB packages 26 required for a vending machine 12 that offers a variety of beverage selections. Two BIB packages 26 containing the same type of beverage syrup can be sequentially connected together by a changeover valve 32. Changeover valves 32 are known in the prior art and sequentially place BIB packages having a full supply of syrup as a connected BIB package is depleted of syrup. The BIB packages 26 can be stored in cabinet 14 on racks **14*a* used to support BIB packages 26. The BIB packages 26 stored within auxiliary cabinet 14 are interconnected to vending machine 12 by conduits 28, 38 (as best shown in FIG. 2) which form a part of beverage dispensing system 16**.

Beverage dispensing system 16 pumps syrup from the BIB packages 26 to an output nozzle 30 which directs the beverage syrup to an awaiting cup. FIG. 2 schematically shows a beverage dispensing system 16 designed to pump beverage syrup from a single type of beverage offered by vending machine 12. The beverage dispensing system 16 shown in FIG. 2 is duplicated to allow for dispensing of other types of beverages offered by vending machine 12. Beverage dispensing system 16 includes a first pumping stage 34 and a second pumping stage 36. First pumping stage 34 is used to withdraw syrup from the BIB package and to pump the syrup downstream from the auxiliary cabinet 14 to the second pumping stage located in vending machine 12. In response to payment and selection of beverage, the second pumping stage 36 pumps a predefined selected amount of syrup through output nozzle 30 and into an awaiting cup.

First pumping stage 34 includes a BIB pump 40 used to draw syrup from BIB packages 26. The intake stroke of the BIB pump 40 creates a vacuum which draws syrup from a BIB package 26 through a supply conduit 28 constructed of PVC tubing and to pump 40. The discharge stroke of BIB pump 40 pumps the drawn syrup downstream towards the second pumping stage 36 through a feed conduit 38 constructed of LDPE tubing. BIB pump 40 is powered by a $CO_2$ cylinder 42 located in vending machine 12.

A vent valve 44 is positioned in feed conduit 38 to remove any air intermixed with the syrup pumped from the BIB pump 40. Vent valves 44 are known in the prior art and may be referred to as a "BIB vent". The vent valve 44 used in the preferred embodiment of the invention is offered by the Lancer Corporation and is identified as P.N. 82-0290. Vent valve 44 functions to remove any air that may have entered the dispensing system 16 during the first pumping stage 34. Air tends to enter dispensing system 16 because of pre-existing air in the bag of a BIB package 26. The flexible nature of the BIB package's bag allows air within the bag to be drawn into supply conduit 28 when the intake stroke of pump 40 draws syrup from a BIB package 26. Removal of air from dispensing system 16 is important due to the inability of the second pumping stage 36 to draw the proper mount of syrup when air is intermixed with the syrup.

Second pumping stage 36 includes a diaphragm pump or a bellows pump 46 (hereinafter referred to as bellows pump 46) positioned upstream of output nozzle 30. Bellows pumps and diaphragm pumps are currently used in prior art cup-type vending machines. Bellows pump 46 has an intake stroke that creates a vacuum to withdraw a pre-selected amount of syrup from the first pumping stage 34. The output stroke of the bellows pump forces the selected amount of syrup through output nozzle 30 and into an awaiting cup. Positioned between bellows pump 46 and vent valve 44 is vacuum pressure regulator 50. Vacuum pressure regulator 50 prevents syrup in the pressurized feed conduit 38 from inadvertently passing through the bellows pump 46 and also controls the flow of fluid delivered to the bellows pump when it is activated.

While vacuum pressure regulator 50 is the preferred form of fluid flow restricting means, other types could be used, such as, for example, an electrically-operated solenoid valve with a fluid flow control device. The fluid flow control device may be, by way of example, a turbine flow meter, a flow control, a metering stem, or a timer. If a solenoid valve with a fluid flow control device used, a bellows pump, diaphragm pump, or the like need not be present. Embodiments according to the present invention utilizing solenoid valves are discussed in more detail below.

In operation, beverage vending system 10 operates as follows. BIB packages 26 are stored in auxiliary cabinet 14. For each beverage offered by vending machine 12, a pair of BIB packages 26 are connected in parallel to a change-over valve 32. A single BIB package can be used, but a pair of BIB packages connected by a changeover valve is preferred to limit the intervals at which vending system 10 must be restocked. Once the BIB packages 26 are connected with beverage dispensing system 16, the first pumping stage 34 begins pumping syrup contained within one of the BIB packages 26 downstream towards the second pumping stage 36. The intake stroke of the BIB pump 40 produces a vacuum which draws syrup from the BIB package 26 on-line and through supply conduit 28, while the output stroke of the BIB pump 40 forces syrup downstream through feed conduit 38 and towards vent valve 44.

The syrup under pressure from BIB pump 40 is directed through vent valve 44 connected along feed conduit 38. Vent valve 44 releases air that may be intermingled with the syrup. As new BIB packages 26 are brought on-line, air tends to enter the beverage dispensing system 16. First pumping stage 34 is used to transfer syrup located in auxiliary cabinet 14 to the second pumping stage 36 located in vending machine 12. Vent valve 44 functions to condition the syrup drawn from BIB packages 26 such that only pressurized syrup without intermingled air is transferred to second pumping stage 36.

Vacuum pressure regulator 50 prevents the pressurized syrup from the first pumping stage from being passed directly to bellows pump 46. Syrup from first pumping stage 34 must be sufficiently pressurized to continuously and uniformly transfer the syrup from the remote cabinet 14 to the vending machine 12. However, the pressurized syrup from the first pumping stage may cause the bellows pump to malfunction if the syrup is allowed to pass directly to the bellows pump 46. Typical bellows pumps 46 are not ordinarily designed to withstand much pressure at their intake port and will inadvertently discharge syrup if the syrup from the first pumping stage 34 is allowed to pass directly to the bellows pump 46. To prevent inadvertent discharges from the bellows pump 46, vacuum pressure regulator 50 is placed between bellows pump 46 and vent valve 44. Vacuum pressure regulator 50 allows syrup to pass to bellows pump 46 only in response to a vacuum created by the intake stroke of bellows pump 46.

Bellows pump 46 is activated to dispense a pre-selected quantity of syrup in response to a customer's insertion of payment into currency input device 20 and selection of a beverage. Once a customer has made a sufficient payment to vending machine 12 and also pressed a beverage selection button 22, bellows pump 46 cycles to dispense a pre-selected amount of syrup into a cup positioned into cup dispensing chamber 24. A cycle of the bellows pump 46 includes an intake stroke which produces a vacuum which causes vacuum pressure regulator 50 to release syrup from the first pumping stage 34. The released syrup is a pre-selected amount of syrup required to supply a single cup. The output stroke of the bellows pump 46 then forces the pre-selected amount of syrup through output nozzle 30 and into a cup. A complete vend occurs when the preselected amount of syrup is forced from the bellows pump 46 during the output stroke and when the preselected amount of syrup is drawn into the bellows pump 46 during the intake stroke.

The beverage vending system 10 of the present invention has two primary advantages over prior art cup-type vending systems. First vending system 10 of the present invention allows a vending machine operator to store a much larger number of BIB packages 26 and other components such that vending system 10 requires less frequent stocking of BIB packages 26. In addition, when restocking the cup-type vending system 10, access to the vending machine 12 is not required. Second, the air problem associated with cup-type vending machines of the prior art is solved by including a dispensing system 16 having both a first and second pumping stages 35,36 with a vent valve positioned therebetween.

Figure 3:
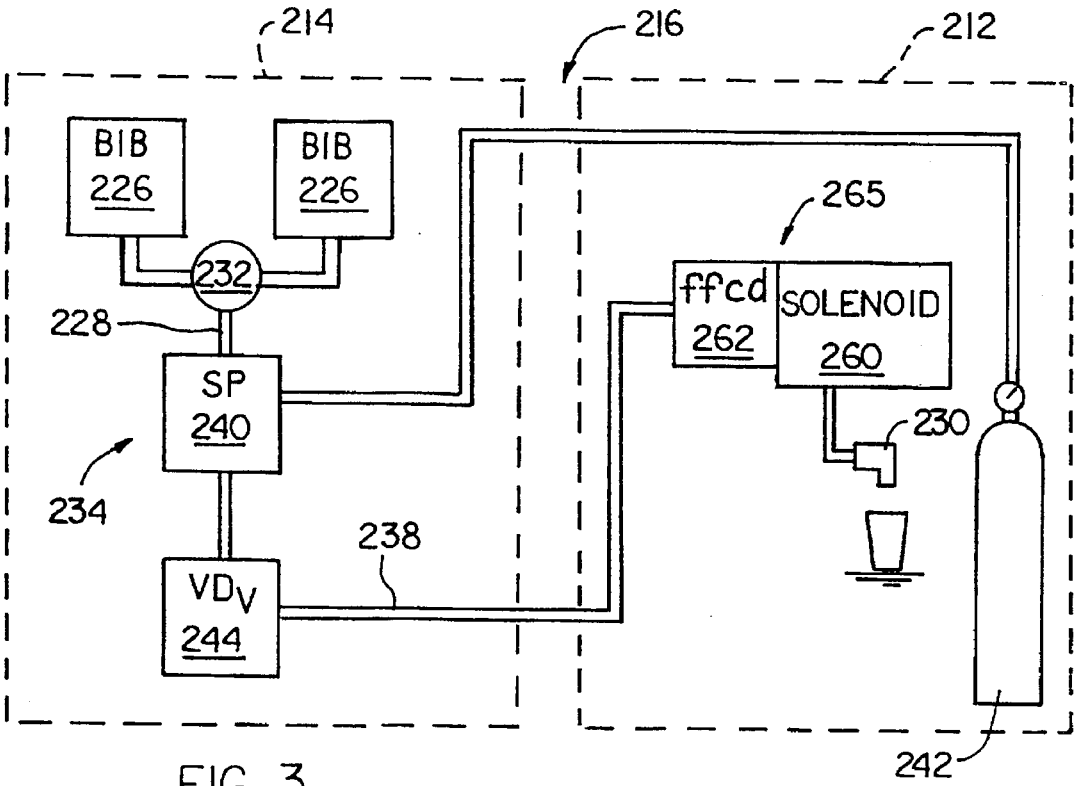
FIG. 3 is a schematic view of a beverage dispensing system incorporating a syrup delivery kit according to a second embodiment of the present invention.

With reference to FIG. 3, a beverage dispensing system 216 according to a second embodiment of the present invention is shown therein. Beverage dispensing system 216 includes vending machine 212, remote cabinet 214, BIB packages 226, supply conduit 228, nozzle 230, changeover valve 232, first pumping stage 234, feed conduit 238, supply pump 240, and $CO_2$ cylinder 242 corresponding to elements 12, 14, 26, 28, 30, 32, 34, 38, 40, and 42 of beverage dispensing system 16 as described above, respectively. Beverage dispensing system 216 also includes vent device ($VD_v$) 244 which is a vent valve corresponding to vent valve 44 of the first embodiment. Notably, there is no second pumping stage or second pump such as a bellows pump or diaphragm pump, as found in the first embodiment. Rather, system 216 includes fluid flow control means 265. Fluid flow restricting means 265 includes fluid flow control device 262 and solenoid valve 260. Fluid flow control device 262 and solenoid 260 are interposed in feed conduit 238 between vent valve 244 and nozzle 230. Fluid flow control device 262 is operative to control the opening and closing of solenoid valve 260 in response to a vend request (e.g, receipt of currency at the currency input device 20).

Solenoid valve 260 may be any suitable solenoid valve, such devices being well-known. Fluid flow control device 262 may be, by way of example, a turbine flow meter, a flow control, a metering stem, or a timer. In the case of a turbine flow meter, for example, the turbine flow meter measures the flow of syrup through feed conduit 238 or solenoid valve 260 and causes solenoid valve 260 to close when a preselected volume of syrup has passed through the turbine flow meter. In the case of a timer, for example, the timer holds the solenoid valve 260 open for a preselected period of time, the period of time corresponding to the desired volume to be dispensed at because a flow rate.

Because a solenoid valve is used in place of a bellows pump or diaphragm pump, the vacuum pressure regulator of the first embodiment is not required. The solenoid valve seals sufficiently when closed to prevent leakage toward the nozzle.

In response to customer input of currency at the currency input device, fluid flow control device 262 opens solenoid valve 260 and supply pump 240 is actuated. Operation of beverage dispensing system 216 according to the second embodiment is similar to that of system 16 according to the first embodiment. Syrup is drawn from BIB packages 226 through supply conduit 228 by means of supply pump 240. The syrup under pressure from supply pump 240 is directed through vent valve 244 connected along feed conduit 238. Vent valve 244 releases air that may be intermingled with the syrup. Subsequent to passing through vent valve 244, the syrup continues through feed conduit 238 to fluid flow control means 265. If the fluid flow control device 262 is a turbine flow meter, for example, solenoid valve 260 will remain open until a preselected volume has passed therethrough, so that such a predetermined volume will be dispensed from nozzle 230. If fluid flow control device 262 is a timer, for example, then solenoid valve 260 will be held open for a preselected time period, thereby allowing a preselected volume of syrup to be dispensed through nozzle 230.

Supply pump 240 could be an electric pump rather than a gas driven pump. If supply pump 240 is an electric pump, then it may be actuated and deactuated by a pressure control switch so that, when the pressure in feed conduit 238 is relieved by opening solenoid valve 260, supply pump 240 is actuated and, when the solenoid valve is closed and the pressure in the feed conduit returns to a reference pressure, supply pump 240 stops.

Figure 4:
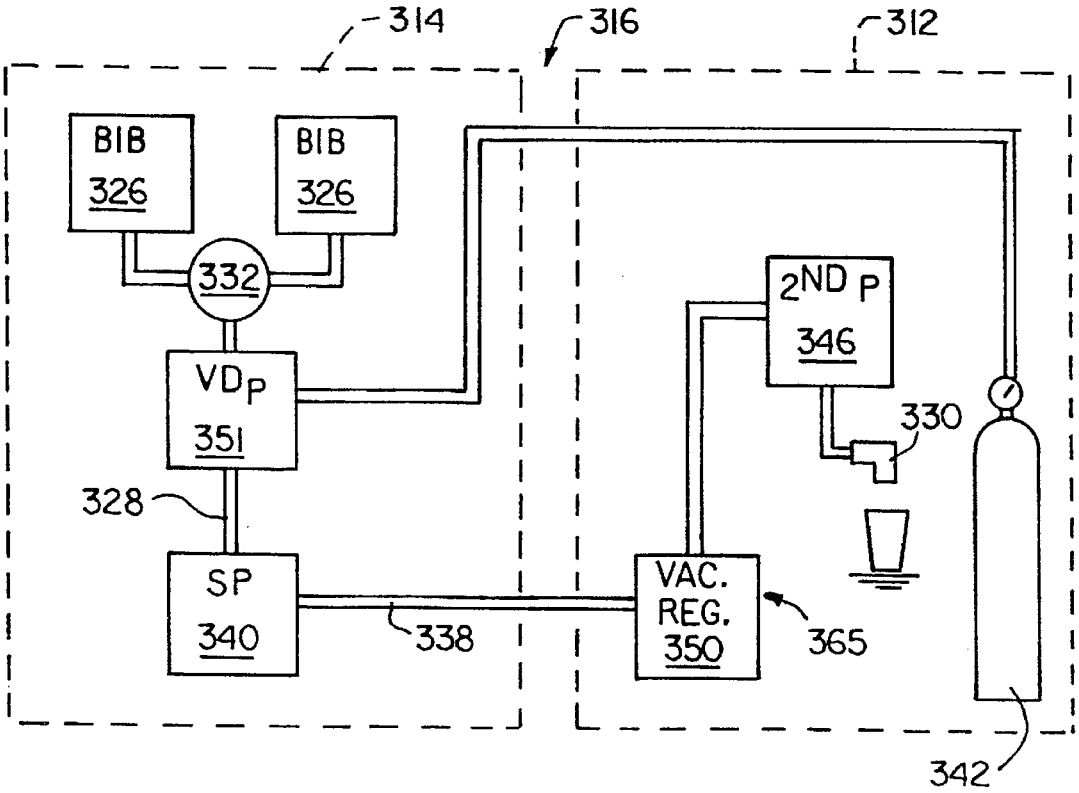
FIG. 4 is a schematic view of a beverage dispensing system incorporating a syrup delivery kit according to a third embodiment of the present invention.

With reference to FIGS. 4 and 4A, a beverage dispensing system 316 according to a third embodiment of the present invention is shown therein. Vending machine 312, remote cabinet 314, BIB packages 326, supply conduit 328, nozzle 330, changeover valve 332, feed conduit 338, supply pump 340, and $CO_2$ cylinder 342 correspond to elements 12, 14, 26, 28, 30, 32, 38, 40, and 42 of the first embodiment, respectively. System 316 according to the third embodiment incorporates a vent device ($VD_p$) 351, as described in more detail below, instead of vent devices 44, 244 as discussed above. Vent device 351 is interposed in supply conduit 328 between BIB packages 326 and supply pump 340. Dispensing system 316 further includes second pump 346 which may be, for example, a bellows pump or diaphragm pump as described above. Fluid flow restricting means 365, preferably a vacuum pressure regulator 350, is interposed in feed conduit 338 between supply pump 340 and second pump 346.

Vent device ($VD_p$) 351 as used in the third embodiment is an air evacuator pump.

In operation, second pump 346 is activated to dispense a preselected quantity of syrup in response to a customer's insertion of payment into the currency input device. Second pump 346 cycles to dispense a preselected amount of syrup through nozzle 330. A cycle of second pump 346 includes an intake stroke which produces a vacuum which causes vacuum pressure regulator 350 to open, allowing syrup to pass therethrough. In ram, the pressure of the syrup in the line between supply pump 340 and vacuum pressure regulator 350 is reduced, whereupon supply pump 340 begins to run until the pressure in the feed conduit is again at the desired level. The output stroke of second pump 346 then forces the preselected amount of syrup through output nozzle 330. A complete vend occurs when the preselected amount of syrup is forced from second pump 346 during the output stroke and when the preselected amount of syrup is drawn into second pump 346 during the intake stroke. Vent device 351 insures that no air is intermingled with the syrup drawn by second pump 346.

Again, gas driven supply pump 340 could be replaced with an electric pump and a pressure switch in the line between the supply pump and the vacuum pressure regulator.

Figure 5:
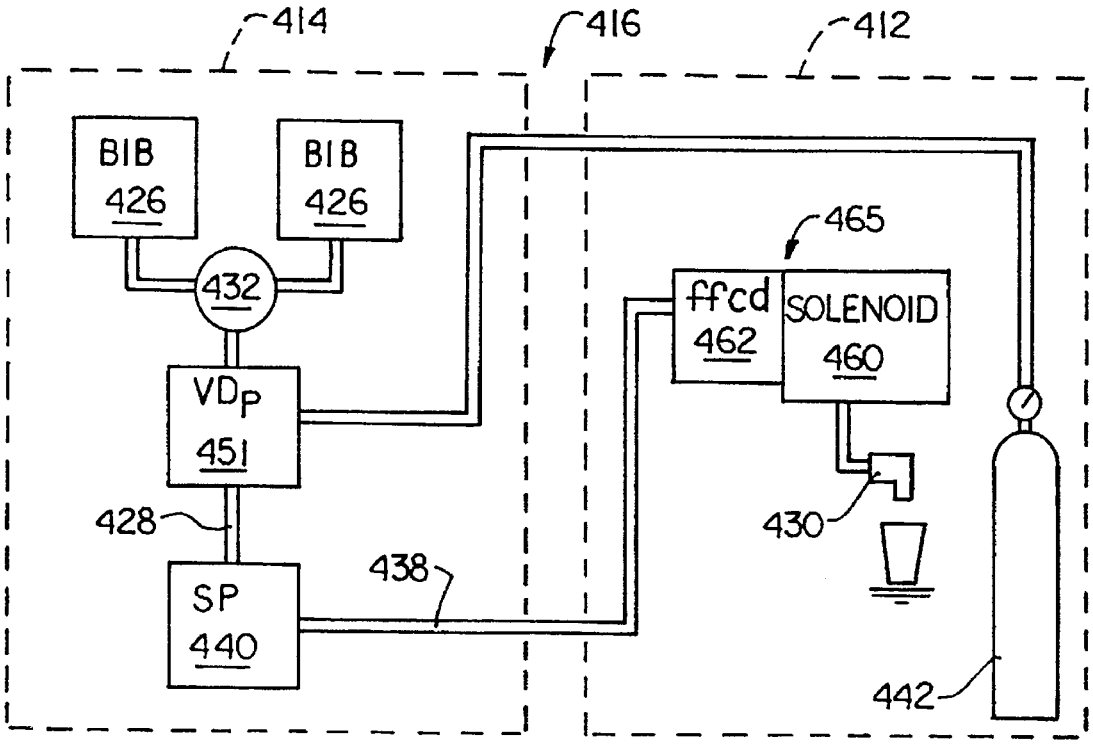
FIG. 5 is a schematic view of a beverage dispensing system incorporating a syrup delivery kit according to a fourth embodiment of the present invention.

With reference to FIG. 5, a beverage dispensing system 416 according to a fourth embodiment of the present invention is shown therein. Vending machine 412, remote cabinet 414, BIB packages 426, supply conduit 428, nozzle 430, changeover valve 432, feed conduit 438, supply pump 440, and $CO_2$ cylinder 442 correspond to elements 312, 314, 326, 328, 330, 332, 338, 340, and 342 of the third embodiment, respectively. System 416 according to the fourth embodiment incorporates an air evacuator pump vent device 451 corresponding to vent device 351 of the third embodiment. Notably, there is no second pump such as a bellows pump or diaphragm pump, as found in the third embodiment. Rather, system 416 includes fluid flow control means 465. Fluid flow restricting means 465 includes fluid flow control device 462 and solenoid valve 460. Fluid flow control device 462 and solenoid 460 are interposed in feed conduit 438 between supply pump 440 and nozzle 430. Fluid flow control device 462 is operative to control the opening and closing of solenoid valve 460 in response to a vend request. Vent device 451 is interposed in supply conduit 428 between BIB packages 426 and supply pump 440, and is operative to remove air from the syrup.

As in the second embodiment, solenoid valve 260 may be any suitable solenoid valve. Again, fluid flow control device 462 may be, by way of example, a turbine flow meter, a flow control, a metering stem, or a timer.

Because a solenoid valve is used in place of a second pump, the vacuum pressure regulator of the third embodiment is not required. The solenoid valve seals sufficiently when closed to prevent leakage toward the nozzle.

In response to customer input of currency at the currency input device, fluid flow control device 462 opens solenoid valve 460 and supply pump 440 is actuated. Operation of beverage dispensing system 416 according to the fourth embodiment is similar to that of system 316 according to the third embodiment. Syrup is drawn from chamber-type vent device 451 through supply conduit 428 by means of supply pump 440. The syrup drawn from vent device 451 is previously freed of air as discussed above with regard to the third embodiment. The syrup drawn by supply pump 440 is forced through feed conduit 438 to fluid flow restricting means 465.

Again, as in the second embodiment, supply pump 440 may be an electric pump actuated and deactuated by a pressure control switch so that, when the pressure in feed conduit 438 is relieved by opening solenoid valve 460, supply pump 440 is actuated and, when the solenoid valve is closed and the pressure in the feed conduit returns to a reference pressure, supply pump 440 stops.

Figure 6:
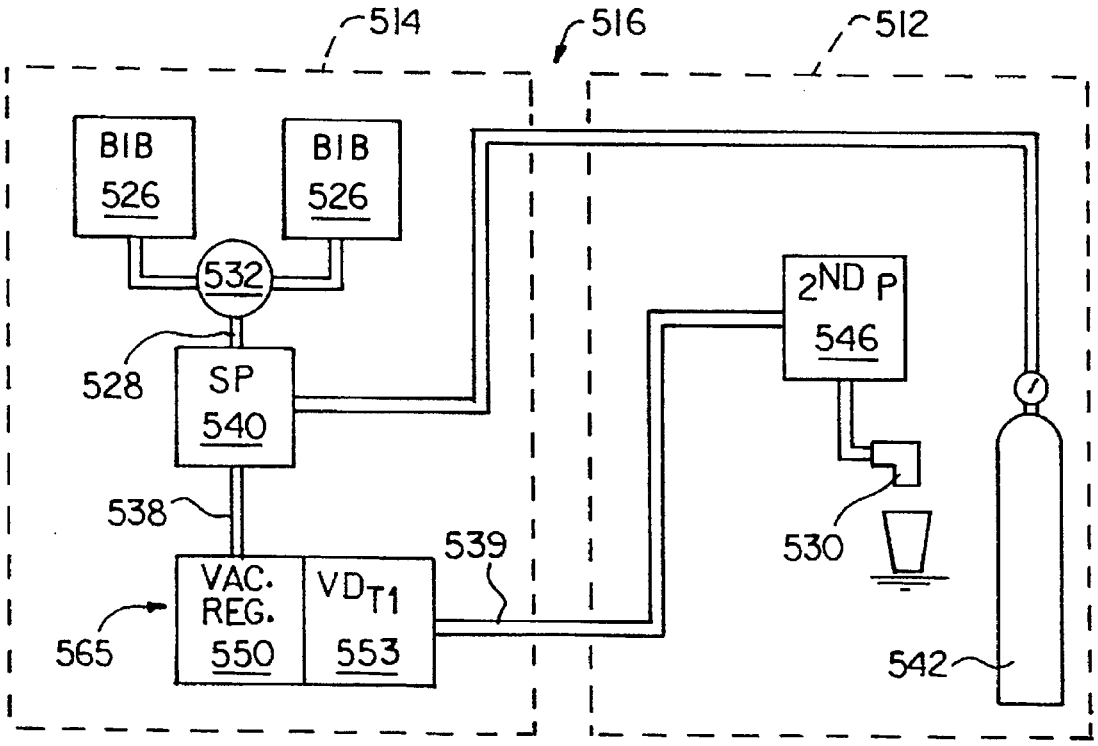
FIG. 6 is a schematic view of a beverage dispensing system incorporating a syrup delivery kit according to a fifth embodiment of the present invention.
Figure 6A:
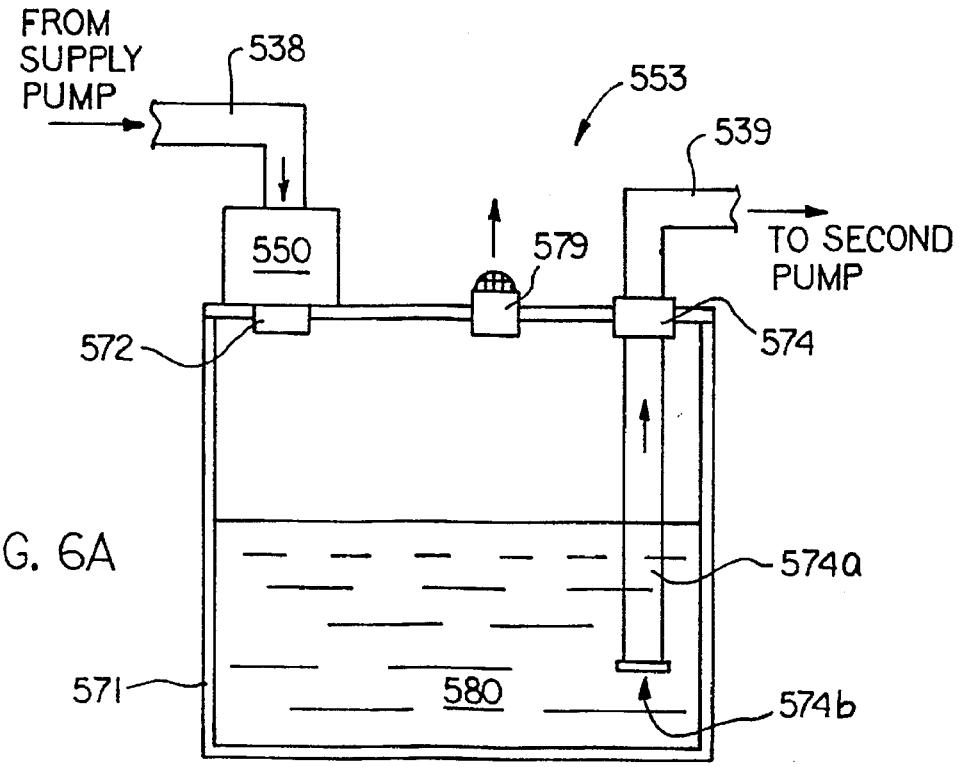
FIG. 6A is a schematic view of a first type tank vent device forming a part of the syrup delivery kit according to the fifth embodiment.

With reference to FIGS. 6 and 6A, a beverage dispensing system 516 according to a fifth embodiment of the present invention is shown therein. Vending machine 512, remote cabinet 514, BIB packages 526, supply conduit 528, nozzle 530, changeover valve 532, feed conduit 538, supply pump 540, and $CO_2$ cylinder 542 correspond to elements 12, 14, 26, 28, 30, 32, 38, 40, and 42 of the first embodiment, respectively. System 516 according to the fifth embodiment incorporates a first type tank vent device ($VD_{T1}$) 553 instead of vent devices 44, 244, 351, and 451. Fluid flow restricting means 565, preferably a vacuum pressure regulator 550, is interposed in feed conduits 538,539 between supply pump 540 and first type tank vent device 553. System 516 is provided with second pump 546 which may be, for example, a bellows pump or a diaphragm pump.

As best seen in FIG. 6A, first type tank vent device 553 as used in the fifth embodiment is shown therein. Vent device 553 includes container 571, enclosed on all sides. Syrup 580 is contained therein. Syrup 580 enters container 571 from feed conduit 538 through opening 572. Passage of syrup from feed conduit 538 through opening 572 is regulated by vacuum regulator 550. Syrup 580 may be withdrawn from container 571 through opening 576*b* of tube 574*a* which is interconnected with feed conduit 539 at opening 574. Vent opening 579, preferably an exit only vent, is provided in the top of container 571 to allow the passage of air therethrough (i.e., out of container 571). More particularly, as the level of syrup 580 rises, air within container 571 is displaced out through opening 579. As liquid syrup is drawn from the container, a vacuum is created in the container which causes vacuum regulator 550 to open and allow the passage of syrup from feed conduit 538 to enter the container and thereby restore the pressure in the container. Syrup will continue to enter the container until the pressure or vacuum in the container is again at the reference level.

In operation, second pump 546 is activated to dispense a preselected quantity of syrup in response to a customer's insertion of payment into the currency input device. Second pump 546 cycles to dispense a preselected amount of syrup through nozzle 530. A cycle of second pump 546 includes an intake stroke which produces a vacuum which causes syrup 580 to be drawn through opening 574 and feed conduit 539. The output stroke of second pump 546 then forces the preselected amount of syrup through output nozzle 530. A complete vend occurs when the preselected amount of syrup is forced from second pump 546 during the output stroke and when the preselected amount of syrup is drawn into second pump 546 during the intake stroke.

The provision of first type tank vent device 553 in conjunction with fluid flow restricting means 565 insures that no air is intermingled with the syrup delivered to second pump 546 through feed conduit 539. When second pump 546 draws an amount of syrup 580 sufficient to create a certain degree of vacuum or greater, vacuum regulator 550 allows syrup from supply conduit 538 to enter container 571, thereby maintaining the level of syrup in the container. Air intermingled with the syrup from the BIB packages percolates upward out of the syrup once the syrup is deposited in container 571. Hence, the syrup drawn through opening 574*b* is substantially free of air.

Again, supply pump 540 may be an electric pump actuated and deactuated by a pressure control switch so that, when the pressure in feed conduit 538 is relieved by opening the vacuum regulator 550, supply pump 540 is actuated and, when the vacuum regulator is closed and the pressure in the feed conduit returns to a reference pressure, supply pump 540 stops.

Figure 7:
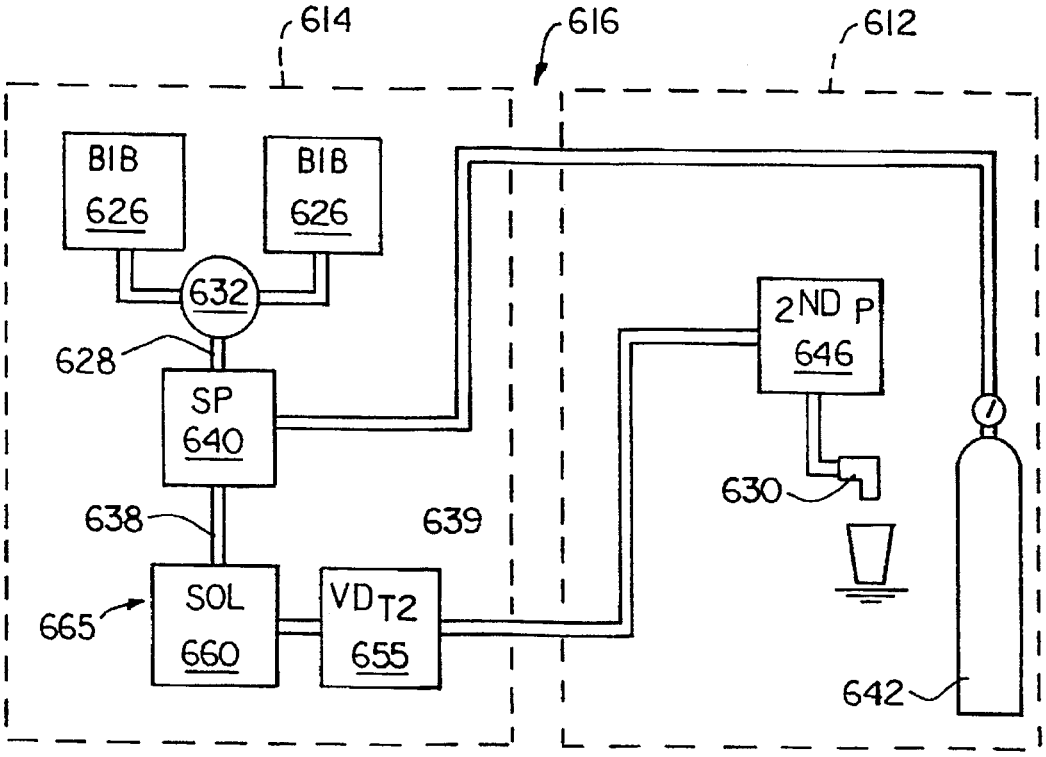
FIG. 7 is a schematic view of a beverage dispensing system incorporating a syrup delivery kit according to a sixth embodiment of the present invention.
Figure 7A:
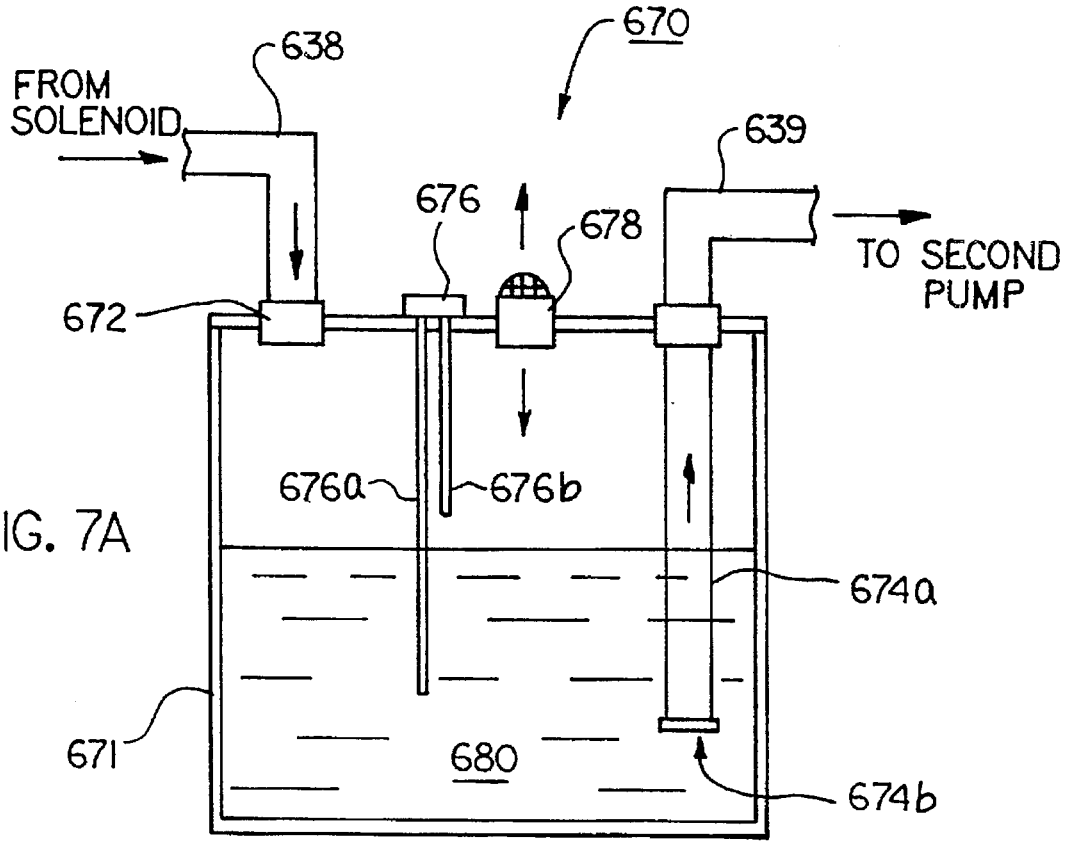
FIG. 7A is a schematic view of a second type tank vent device forming a part of the syrup delivery kit according to the sixth embodiment.

With reference to FIGS. 7 and 7A, a beverage dispensing system 616 according to a sixth embodiment of the present invention is shown therein. Vending machine 612, remote cabinet 614, BIB packages 626, supply conduit 628, nozzle 630, changeover valve 632, feed conduit 638, supply pump 640, and $CO_2$ cylinder 642 correspond to elements 12, 14, 26, 28, 30, 32, 38, 40, and 42 of the first embodiment, respectively. System 616 according to the sixth embodiment incorporates a second type tank vent device ($VD_{T2}$) 655 instead of vent devices 44,244 as discussed above. Fluid flow restricting means 665, preferably solenoid valve 260, is interposed in feed conduit 638 between supply pump 640 and second type tank vent device 655. System 616 is provided with second pump 646 which may be, for example, a bellows pump or a diaphragm pump.

As best seen in FIG. 7A, second type tank vent device 655 as used in the sixth embodiment is shown therein. Vent device 655 includes container 671, enclosed on all sides. Syrup 680 is contained therein. Syrup 680 enters container 671 from feed conduit 638 and through opening 672. Syrup 680 may be withdrawn from container 671 through opening 674*b* of tube 674*a* which is interconnected with feed conduit 639 at opening 674. Two-way vent opening 678 is provided in the top of container 671 to allow the passage of air therethrough. More particularly, as the level of syrup 680 rises, air within container 671 is displaced out through opening 678. As liquid is drawn from the container, air is drawn into the tank through the vent opening to equalize the pressure in the tank. Second type tank vent device 655 is further provided with switch 676. Switch 676 includes long contact 676*a* and short contact 676*b*. When the level of syrup 680 reaches short contact 676*b*, syrup 680 serves as a conductor between long contact 676*a* and short contact 676*b* thereby providing electrical continuity therebetween. When such condition occurs, switch 676 is deactuated. It will be appreciated that other types of fluid level switches may be used as well, for example, a float switch or a float/magnet combination switch.

In operation, second pump 646 is activated to dispense a preselected quantity of syrup in response to a customer's insertion of payment into the currency input device. Bellows pump 646 cycles to dispense a preselected amount of syrup through nozzle 630. A cycle of second pump 646 includes an intake stroke which produces a vacuum which causes syrup 680 to be dram through opening 674 and feed conduit 639. The output stroke of the second pump 646 forces the preselected amount of syrup from second pump 646 and the preselected amount of syrup is drawn into second pump 646 during the intake stroke.

In order to insure that no air is intermingled with the syrup drawn by second pump 646 from vent device 655, vent device 655, supply pump 640, and solenoid valve 660 are cooperatively interconnected. When second pump 646 draws an amount of syrup 680 sufficient to drop the level of syrup 680 in container 671 below the end of short contact **676*b* then switch 676 causes solenoid valve 660 to open. When solenoid valve 660 is opened, the outlet pressure of supply pump 640 is reduced and supply pump 640, as a result, begins drawing syrup from BIB package 626 and pumping the same through feed conduit 638. The syrup so directed passes through feed conduit 638 and opening 672 into container 671, thereby raising the level of syrup 680 in the container. When the level of syrup 680 reaches short contact 676*b*, switch 676 is deactuated, thereby closing solenoid valve 660. When solenoid valve 660 is closed, the outlet pressure of supply pump 640 is increased, thereby causing supply pump 640 to cease operation. In this way, opening 674*b* is always submerged. Air intermingled with the syrup from the BIB packages percolates upward out of the syrup once the syrup is deposited in container 671. Hence, the syrup drawn through opening 674*b*** is free of air.

Again, supply pump 640 may be replaced with an electric pump paired with a pressure switch.

The present invention may, of course, be carried out in other specific ways than those herein set forth without parting from the spirit and essential characteristics of the invention. The present embodiments are, therefore, to be considered in all respects as illustrative and not restrictive, and all changes coming within the meaning and equivalency range of the appended claims are intended to be embraced therein.

I claim:

1. A syrup delivery kit for improving the delivery of syrup in a cup-type vending machine in which the syrup is initially contained in a bag-in-box container, comprising:

a) a fluid flow restricting means;

b) a supply pump for transferring syrup downstream through a feed conduit towards said fluid flow restricting means;

c) a vent device between the bag-in-box container and said fluid flow restricting means, said vent device operative to remove air from the syrup while allowing the syrup to pass through said vent device; and d) supply conduits for interconnecting said supply pump, said vent device, and said fluid flow restricting means together and to said bag-in-box container.

2. The syrup delivery kit of claim 1 wherein said fluid flow restricting means includes a solenoid valve having a fluid flow control device.

3. The syrup delivery kit of claim 2 wherein said fluid flow control device is a flow meter.

4. The syrup delivery kit of claim 2 wherein said fluid flow control device is a timer.

5. The syrup delivery kit of claim 2 wherein said vent device is disposed between said supply pump and said solenoid valve.

6. The syrup delivery kit of claim 5 wherein said fluid flow control device is a flow meter.

7. The syrup delivery kit of claim 5 wherein said fluid flow control device is a timer.

8. A syrup delivery kit for improving the delivery of syrup in a cup-type vending machine in which the syrup is initially contained in a bag-in-box container, comprising:

a) a fluid flow restricting means;

b) a supply pump for transferring syrup downstream through a feed conduit towards said fluid flow restricting means;

c) a vent device between the bag-in-box container and said supply pump, said vent device operative to remove air from the syrup while allowing the syrup to pass through said vent device; and d) supply conduits for interconnecting said supply pump, said vent device, and said fluid flow restricting means together and to said bag-in-box container.

9. The syrup delivery kit of claim 8 further including a second pump downstream of said supply pump.

10. The syrup delivery kit of claim 9 wherein said fluid flow restricting means is disposed between said supply pump and said second pump.

11. The syrup delivery kit of claim 10 wherein said fluid flow restricting means is a regulator.

12. The syrup delivery kit of claim 8 wherein said fluid flow restricting means includes a solenoid valve having a fluid flow control device.

13. The syrup delivery kit of claim 12 wherein said fluid flow control device is a flow meter.

14. The syrup delivery kit of claim 12 wherein said fluid flow control device is a timer.

15. A syrup delivery kit for improving the delivery of syrup in a cup-type vending machine in which the syrup is initially contained in a bag-in-box container, comprising:

a) a fluid flow restricting means;

b) a supply pump for transferring syrup downstream through a feed conduit towards said fluid flow restricting means;

c) a vent device downstream from said fluid flow restricting means, said vent device operative to remove air from the syrup while allowing the syrup to pass through said vent device; and d) supply conduits for interconnecting said supply pump, said vent device, and said fluid flow restricting means together and to said bag-in-box container.

16. The syrup delivery kit of claim 15 wherein said fluid flow restricting means is a regulator.

17. The syrup delivery kit of claim 15 wherein said fluid flow restricting means includes a solenoid valve having a fluid flow control device.

18. The syrup delivery kit of claim 17 wherein said fluid flow control device is a flow meter.

19. The syrup delivery kit of claim 17 wherein said fluid flow control device is a timer.

20. The syrup delivery kit of claim 15 further including a second pump downstream from said vent device.

21. The syrup delivery kit of claim 20 wherein said fluid flow restricting means is a regulator.

22. The syrup delivery kit of claim 20 wherein said fluid flow restricting means includes a solenoid valve having a fluid flow control device.

23. The syrup delivery kit of claim 22 wherein said fluid flow control device is a flow meter.

24. The syrup delivery kit of claim 22 wherein said fluid flow control device is a timer.

* * * * *